US007690888B2

(12) United States Patent
Garnett

(10) Patent No.: US 7,690,888 B2
(45) Date of Patent: Apr. 6, 2010

(54) FAN GRILL

(75) Inventor: Paul Jeffrey Garnett, Camberley (GB)

(73) Assignee: Sun Microsystems, Inc., Santa Clara, CA (US)

( * ) Notice: Subject to any disclaimer, the term of this patent is extended or adjusted under 35 U.S.C. 154(b) by 1185 days.

(21) Appl. No.: 10/809,138

(22) Filed: Mar. 25, 2004

(65) Prior Publication Data

US 2004/0191072 A1 Sep. 30, 2004

(30) Foreign Application Priority Data

Mar. 31, 2003 (GB) ..... 0307437.4

(51) Int. Cl.
*F04D 29/70* (2006.01)

(52) U.S. Cl. ..... 415/121.2; 416/63; 416/247 R

(58) Field of Classification Search ..... 416/247 R, 416/63; 415/121.2; 29/428, 525.14, 897.15; 361/690, 691, 692, 693, 694, 695, 696, 697; 206/499–502, 504–507, 509, 510
See application file for complete search history.

(56) References Cited

U.S. PATENT DOCUMENTS

| | | | | | |
|---|---|---|---|---|---|
| 2,575,770 | A | * | 11/1951 | Roop | 206/514 |
| 2,646,186 | A | * | 7/1953 | Russell | 206/510 |
| 2,821,327 | A | * | 1/1958 | Glazer | 206/203 |
| 2,896,835 | A | * | 7/1959 | Burkhardt et al. | 206/510 |
| RE25,050 | E | * | 10/1961 | Hamilton | 206/510 |
| 3,106,332 | A | * | 10/1963 | Dieguez | 229/117.21 |
| 3,392,874 | A | * | 7/1968 | Peebles | 206/514 |
| 3,587,915 | A | * | 6/1971 | Theobald | 206/201 |
| 3,750,936 | A | * | 8/1973 | Crane | 206/510 |
| 3,991,879 | A | * | 11/1976 | Hirota | 206/203 |
| 4,039,119 | A | * | 8/1977 | Crane | 206/510 |
| 4,621,765 | A | * | 11/1986 | Ortel | 229/117.21 |
| 5,000,079 | A | * | 3/1991 | Mardis | 454/184 |
| 5,086,917 | A | * | 2/1992 | Dziersk et al. | 206/216 |
| 5,490,452 | A | * | 2/1996 | Schlosser et al. | 99/422 |
| 5,822,186 | A | * | 10/1998 | Bull et al. | 361/695 |
| 6,059,109 | A | * | 5/2000 | Stein | 206/373 |
| 6,099,258 | A | * | 8/2000 | Litvin et al. | 416/247 R |
| D441,444 | S | * | 5/2001 | Shapiro | D23/382 |
| 6,288,897 | B1 | * | 9/2001 | Fritschle et al. | 361/687 |

(Continued)

FOREIGN PATENT DOCUMENTS

| | | |
|---|---|---|
| DE | 3533950 | 5/1986 |

(Continued)

OTHER PUBLICATIONS

International search report application No. GB0307437.4 mailed Jun. 30, 2003.

*Primary Examiner*—Edward Look
*Assistant Examiner*—Aaron R Eastman
(74) *Attorney, Agent, or Firm*—Meyertons, Hood, Kivlin, Kowert & Goetzel, P.C.

(57) ABSTRACT

The present invention provides a grill 10 for use in electrical equipment comprising a fan. The grill 10 comprises a substantially planar portion 90 that provides protection for (and indeed from) the blades of a fan and a handle 100 that provides means by which the grill may be held. The substantially planar portion 90 may comprise an opening 94 that facilitates stacking of a plurality of like grills 10.

28 Claims, 4 Drawing Sheets

U.S. PATENT DOCUMENTS 6,336,793 B1 * 1/2002 Litvin ..... 417/360
6,435,889 B1 8/2002 Vinson et al.
D466,606 S * 12/2002 Shapiro ..... D23/411
6,585,489 B2 7/2003 Perella et al.
6,695,577 B1 2/2004 Susek
2006/0157373 A1 * 7/2006 Griffith ..... 206/510

FOREIGN PATENT DOCUMENTS

JP 9189435 7/1997
WO 02/063628 8/2002

* cited by examiner

FAN GRILL

BACKGROUND OF THE INVENTION

The invention relates to fan grills for covering fans or openings in fan housings.

The invention finds particular but not exclusive use in electrical equipment, such as computer systems, which may comprise field replaceable units (FRUs).

Fans are generally provided in electrical equipment such as computer equipment in order to provide cooling for the electrical components thereof. Typically, a fan is mounted inside an enclosure containing the electrical components and an aperture is provided in the chassis defining the enclosure so that hot air may be expelled.

In general, it is desirable to provide grills for fans that provide some level of protection from moving fan blades while presenting minimal restriction to the flow of air in the vicinity of the fan.

Fans have a propensity to collect dirt from the surrounding environment, which can increase the chance of failure and also degrade performance by restricting airflow.

Since fans are electromechanical devices comprising moving parts, they are more likely fail (and hence require replacement/maintenance) than, for example, purely electrical components.

It is generally desirable that the removal and/or replacement of a fan unit be easily and swiftly effected. It is also desirable that removal and/or replacement of the grill from the fan or fan unit itself be easily and swiftly effected.

These considerations are of particular relevance in electrical equipment comprising FRUs wherein there is an emphasis on minimising downtime in the event of a fault.

Accordingly, there is a need for a grill which is easily and removably mountable on a fan or a housing, which facilitates removal of the fan or a fan unit from the system in which it is incorporated.

SUMMARY OF THE INVENTION

In accordance with one aspect of the invention, there is provided a grill configured to be mounted on a surface of a fan or a fan housing. The grill comprises a substantially planar portion and a handle extending out of the planar portion so as to extend away from the surface of the fan or fan housing when the grill is mounted thereon.

The substantially planar portion of the grill provides protection for the blades of a fan while the provision of a handle facilitates mounting and removal of the grill from a fan or fan housing. Furthermore, the handle also provides means by which the fan or fan unit as a whole may be mounted or removed from equipment into which it is incorporated.

The substantially planar portion may be provided with a plurality of apertures. These apertures can facilitate airflow through the grill and reduce the weight of the grill. The apertures can be arranged in a grid. The substantially planar portion may comprise at least one shaped wire arranged to form a loop or partial loop. A number of such loops or partial loops may be provided. These loops or partial loops provide protection for the fan blades while apertures between them allow air to flow through the grill. To strengthen the grill, a number of struts may be provided. Each strut can be attached to one or more of the loops or partial loops thereby providing them with support.

Various embodiments of the invention may comprise an opening in the substantially planar portion arranged to receive the handle of a second grill. In this manner, a number of grills may be stacked together, with the handle of each grill passing through the opening in substantially planar portion of (at least) the next grill in the stack. Such an arrangement can be efficient in terms of packaging since both space and packaging materials are saved.

The handle portion may comprise a piece of wire extending in a loop or partial loop away from the planar portion. This construction can present a minimal obstruction to airflow and economies with regard to the use of materials. Additional pieces of wire may be provided to strengthen the handle.

The grill may be provided with mounting formations for mounting the grill to a fan or fan housing. The mounting formations may comprise shaped wire extending away from the planar portion and arranged to form a loop or partial loop.

One or more of the features of the grill may be integrally formed from a single piece of shaped wire. Construction of the grill may thus be simplified, the number of joins using welds or other jointing techniques may be reduced and the strength of the grill may be increased. Examples of such embodiments include: a grill in which at least one mounting formation and a portion of the handle are integrally formed from a single piece of shaped wire, a grill in which at least one strut and at least a portion of the handle are integrally formed from a single piece of shaped wire, a grill in which at least one mounting formation and strut are integrally formed from a piece of shaped wire and a grill in which at least one mounting formation, strut and at least a portion of the handle are integrally formed from a single piece of shaped wire.

In accordance with an embodiment of the invention, there is provided a combined fan grill and handle comprising: a section of wire shaped to form at least one loop or partial loop arranged in a common plane, including an outermost loop or partial loop; a section of wire shaped to provide support for each loop or partial loop; a first section of wire shaped to form a handle portion; and at least one mount.

In accordance with another aspect of the invention there is provided a method for a covering for an opening in an enclosure, the enclosure at least partially enclosing a fan. The method includes providing a grill comprising a substantially planar portion, and a handle extending out of the planar portion so as to extend away from the surface of the enclosure when the grill is mounted thereon. The method further includes mounting the grill on the surface.

BRIEF DESCRIPTION OF THE DRAWINGS

Embodiments of the present invention will be described hereinafter, by way of example only, with reference to the accompanying drawings in which like reference signs relate to like elements and in which.

Figure 2A:
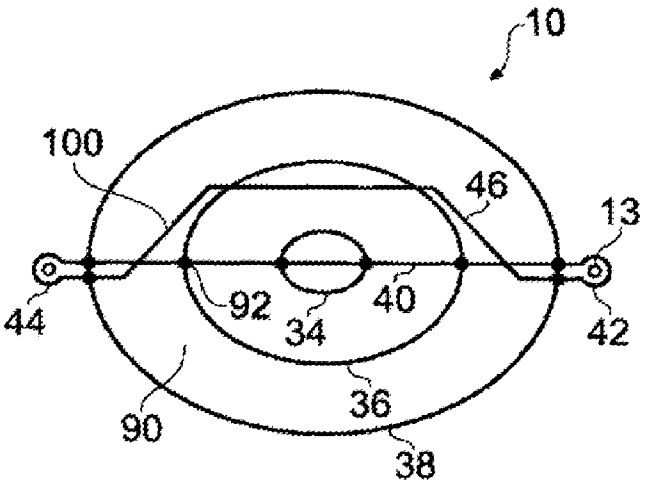
Figure 2B:
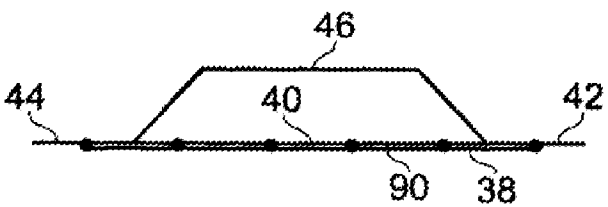
Figure 1A:
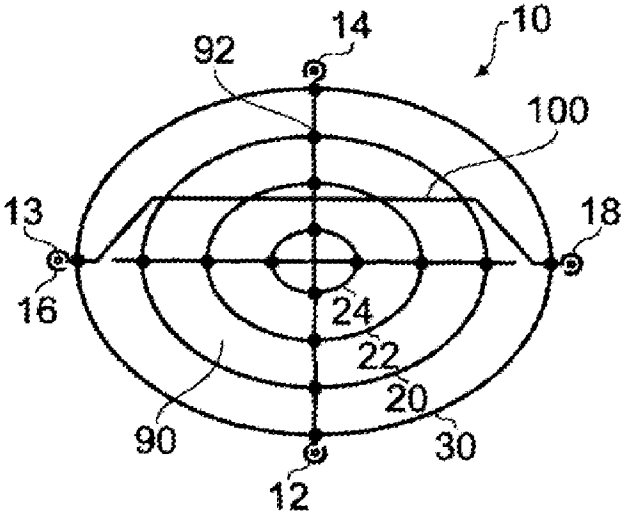
FIG. 1A shows a fan grill in accordance with an embodiment of the present invention.
Figure 3C:
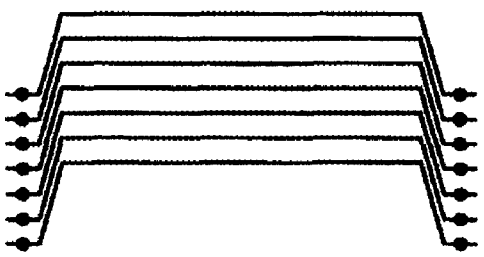
Figure 3D:
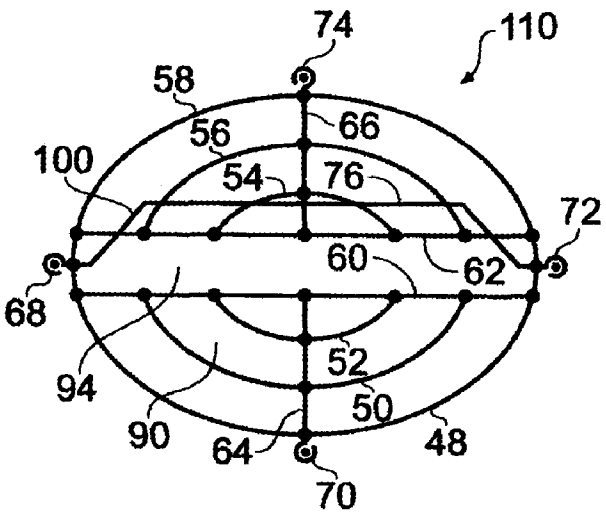
Figure 3A:
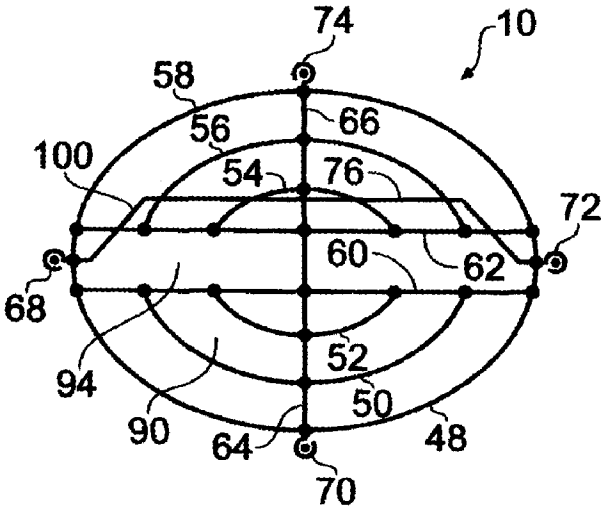
Figure 3B:
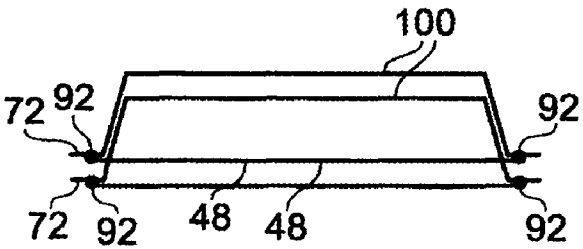
Figure 5:
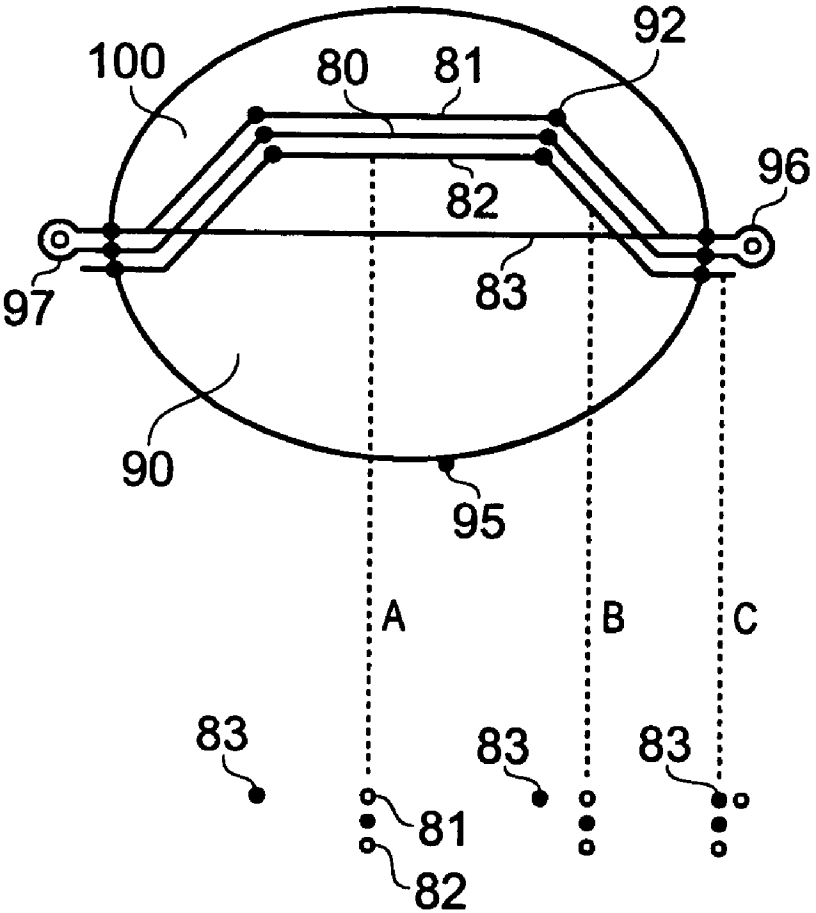
Figure 4:
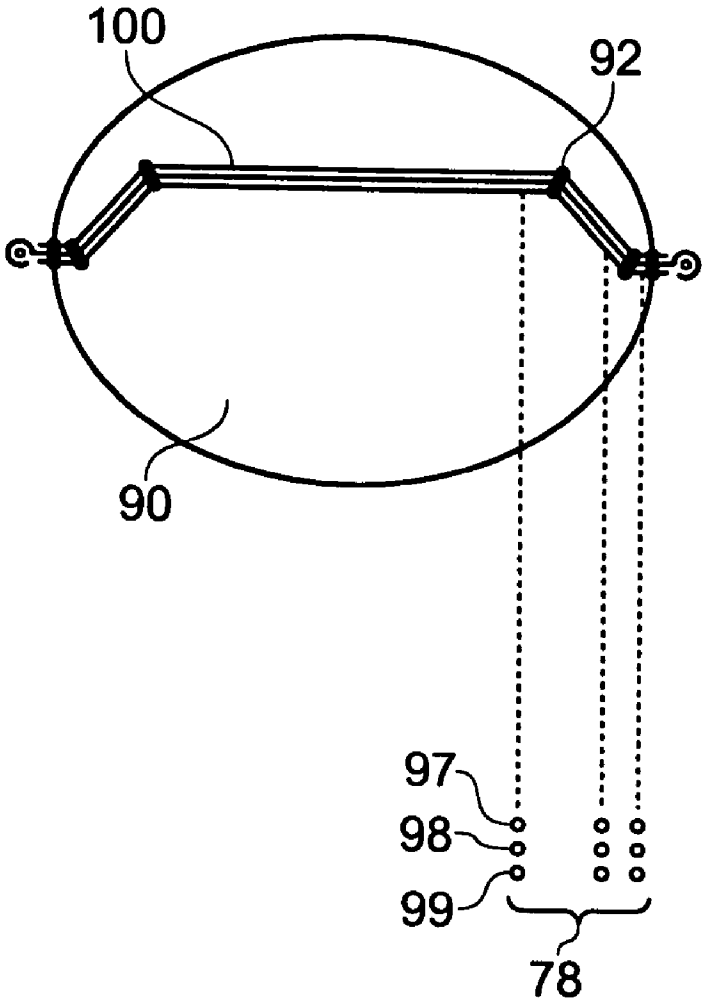
Figure 6:
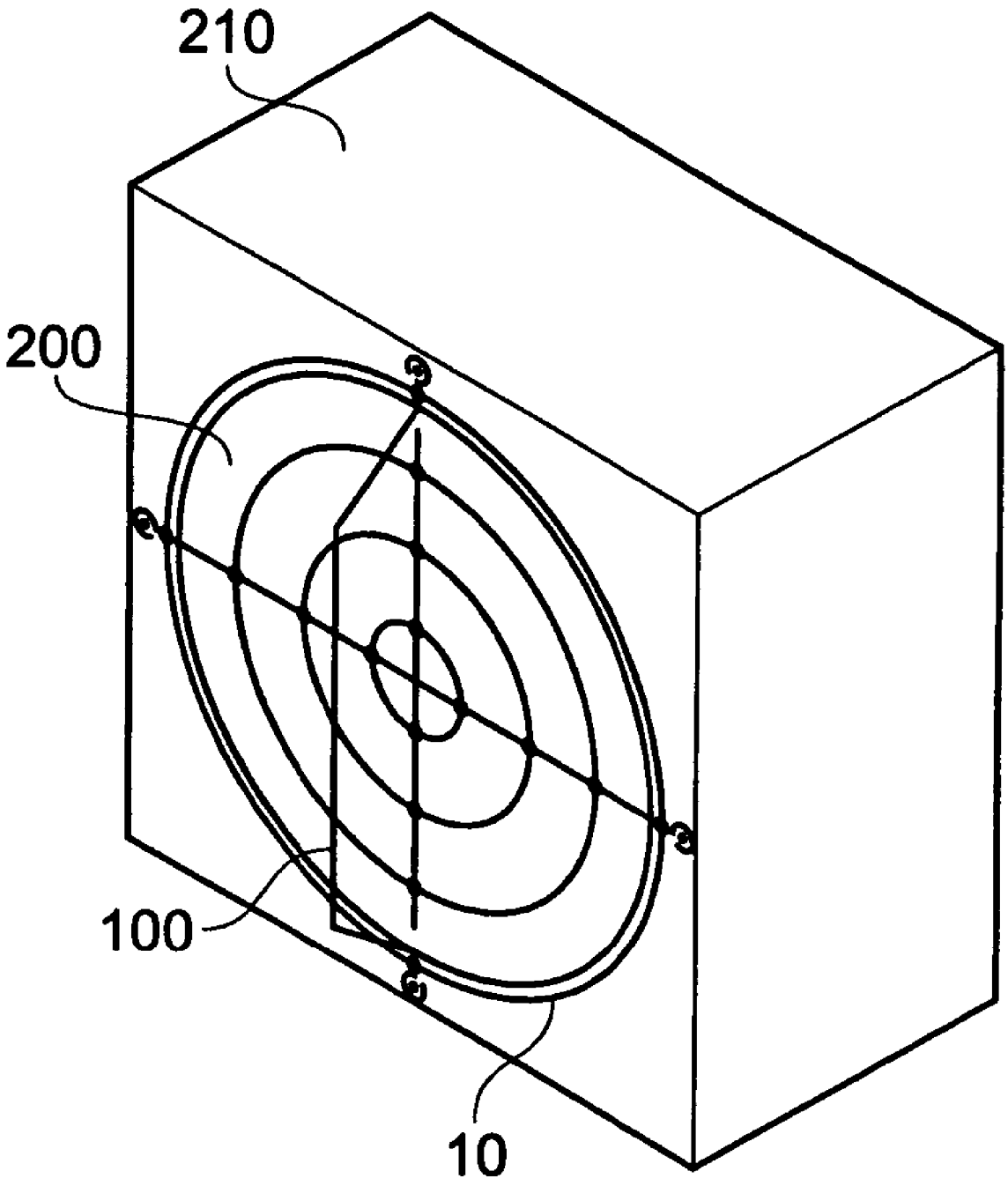

FIG. lB shows a side view of the fan grill shown in FIG. 1A;

FIG. 2A shows a fan grill in accordance with an embodiment of the present invention;

FIG. 2B shows a side view of the fan grill shown in FIG. 2A;

FIG. 3A shows a fan grill in accordance with an embodiment of the present invention;

FIG. 3B illustrates a side view of two grills shown stacked together;

FIG. 3C illustrates a side view of several grills shown stacked together—for clarity, the outermost loop of each grill is not shown in this Figure;

FIG. 4 shows an alternative embodiment of the handle of a fan grill in accordance with an embodiment of the present invention;

FIG. 5 shows an alternative embodiment of the handle of a fan grill in accordance with an embodiment of the present invention; and FIG. 6 is a schematic representation of a fan module with a fan grill.

DESCRIPTION OF PARTICULAR EMBODIMENTS

Various embodiments of the invention are described hereinafter by way of example only.

The various examples of grills 10 described herein include a substantially planar portion 90, which provides protection for (or indeed protection from) the blades of a fan, and also a handle 100 that serves to facilitate mounting of the grill 10 on a fan or on a housing. When the grill 10 is mounted on a fan or a housing, for example a fan housing, the handle 100 also provides a means by which both the grill 10 and fan or fan housing may be lifted or carried as a single item.

One approach that may be taken in providing a grill 10 in accordance with the present invention is to use a wire or wire like construction. Examples of suitable materials for the wire include, for example, metal, or plastics or a combination thereof. Typically a metal is used for reasons of strength and heat and fire resistance. For example, metal wire may be bent or shaped to form a variety of features comprising the grill 10. When plastics are used, construction of the grill 10 may comprise a molding process such as injection molding. In such cases, the end result would be a wire-like construction for the grill although no actual wire is used in the grills construction as such. Accordingly, as used herein, the term 'wire' refers both wire and wire-like features.

The thickness of the wire may vary, but for most applications wire of diameter 1.6 mm (American Wire Gauge (AWG) 14) should prove to be adequate. It is noted that wire that is unnecessarily thick only presents a greater barrier to airflow without significant benefit being accrued in terms of the strength or durability of the grill 10 itself. The choice of wire thickness can be based upon the size of the intended grill 10 and on the type of wire being used, as will be apparent to one skilled in the art.

It is envisaged that wire of various cross sectional shapes could be employed, examples being wires with circular, square or triangular cross sections.

In choosing construction materials for the grill 10, it is not necessary that only a single material or type of wire be employed. For example, a first type of wire may be used to construct the substantially planar portion 90 while a second, different type of wire may be used to form the handle 100. Nevertheless, in a number of embodiments it will be preferable to use only wire of a single type whereby the construction process is simplified and the number of joins or welds used in the grill 10 may be reduced.

Also, although in the present examples a wire like construction is used for the various parts of the grill and handle, in other examples parts of the grill and/or the handle may be formed from a single piece of material. For example, the substantially planar portion and/or the handle may be stamped or otherwise formed from a single piece of sheet material, for example sheet metal.

Turning now to FIG. 1A, there is shown a perspective view of an example of a grill 10 in accordance with an embodiment of the present invention.

A substantially planar portion 90 of the grill 10 comprises four loops 20, 22, 24 and 30 including an outermost loop 30 and two struts 26 and 28. The handle 100 extends out of the substantially planar portion 90 whereby means for holding/manoeuvring the grill are provided. In this embodiment, the grill also comprises four mounting formations 12, 14, 16 and 18. Each mounting formation is configured to facilitate mounting of the grill 10 to corresponding mounting features 13 on a fan or fan housing.

In the present example the loops 20, 22, 24 and 30 are substantially circular in shape and are arranged concentrically. It is envisaged that in other embodiments, non-circular arrangements could be employed such as square, rectangular or ellipse-shaped loops. It is also envisaged that non-concentric arrangements would be possible. For example, the shape of the loops could be matched to the shape of an aperture over which the grill is to be mounted. Furthermore, it will be appreciated that more than one shape of loop could be employed in a single embodiment, one example only of which being shown in FIG. 3A.

As shown in FIG. 1A, the strut 28 can lies across each of the loops 20, 22, 24 and 30 and pass through the centre of the substantially planar portion 90. The strut 28 can be attached to each of the loops 20, 22, 24 and 30 in two places with the attachments 92 indicated. Each of the attachments 92 may comprise a weld or brazing, or some form of adhesive. In the case of a molded grill, a grill stamped from an integral piece of material, or the like, the attachments 92 may not be required as the substantially planar portion may be formed from a single piece on which all the features indicated in FIG. 1A are integrally formed. These considerations also apply to the attachments used in other parts of the grill 10, and indeed to the other embodiments described herein.

The strut 26 can be arranged perpendicular to strut 28 and can lie across each of the loops 20, 22 and 24, for example. The strut 26 can also pass through the centre of the substantially planar portion. Further attachments 92 are provided to attach strut 26 to loops 20, 22 and 24. In this manner it can be seen that the struts 26 and 28 can provide support for the loops 20, 22, 24 and 30 while also providing additional protection for the fan blades. By providing more struts of the kind described here, the size of the apertures provided within the substantially planar portion may be reduced and the grill may be strengthened, which both afford extra protection for the fan. However, this occurs at a cost of inhibiting the flow of air through the grill. Similar considerations apply to the loops (or partial loops) and the number thereof that are provided.

Figure 1B:
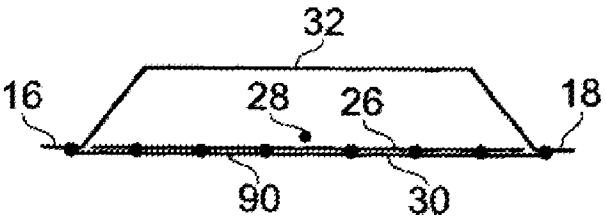

In FIG. 1B, which shows a side view of the fan grill 10, it can be seen that in this example the strut 26 lies on top of each of the loops 20, 22 and 24. As shown, the strut 28 passes over the top of the strut 26 and also lies on top of loops 20, 22, 24 and 30. In alternative embodiments, each of the struts may for instance be arranged such that they are interwoven with the loops provided or in any other appropriate configuration.

The handle 100 in this example comprises a piece of wire 32, shaped so as to form a partial loop, the ends of which are attached 92 to outermost loop 30. The handle is arranged so that (when viewed from above the plane of the substantially planar portion) it runs substantially parallel to the strut 26 and perpendicular to the strut 28.

Each of the mounting formations 12, 14, 16 and 18 can comprise a piece of wire with a first portion which extends linearly away from the substantially planar portion and a second portion which is shaped to form a partial loop.

In the embodiment shown in FIGS. 1A and 1B, each of the mounting formations can be integrally formed with one of the other features of the grill. The mounting formations 12 and 14 and the strut 28 can be formed from a single piece of wire. The mounting formations 16 and 18 and the handle 100 can also be formed from a single piece of wire 32. As described above, this arrangement simplifies the construction of the grill.

The forming more than one feature from a single piece of wire is further illustrated in the embodiment of the invention shown in FIGS. 2A and 2B. Here the substantially planar portion 90 comprises three loops 34, 36 and 38 and a single strut 40. The grill further comprises a handle and two mounting formations 42 and 44. The handle in this example is of itself of similar construction that shown in FIG. 1A. However, from FIG. 2A it can be seen that the two mounting formations 42 and 44, the handle 100 and the strut 40 are all integrally formed from a common wire 46. The mounting formations formed by the single piece of wire 46 each comprise a loop in the wire 46 for mounting on a fan or fan housing via a corresponding mounting feature thereon.

Turning now to FIG. 3A, there is shown a grill 10 that has a substantially planar portion 90 in which an opening 94 is provided. In addition to an outermost ring 48, the substantially planar portion 90 of grill 10 shown in FIG. 3A comprises four partial loops 54/56, and 50/52, which are attached to the struts 60 and 62 respectively. The opening 94 is defined by struts 60 and 62 and also by the portions of the outermost ring 48 proximal the mounting formations 68 and 72.

Two further struts 64 and 66 are also provided although, like struts 60 and 62, these do not pass through the centre of the substantially planar portion 90. In an arrangement similar to that described in relation to FIG. 1A, mounting formations 70 and 74 are integrally formed from a single piece of wire with struts 64 and 66 respectively. Again, in common with the embodiment of FIG. 1A, the handle 100 and two mounting formations 68 and 72 are integrally formed from a single piece of shaped wire 76.

The opening in the substantially planar portion of the grill 10 may in some embodiments be provided with the intention that a number of grills 10 may be stacked in a space efficient manner. In such embodiments, the opening and the handle 100 are arranged such that when two or more grills 10 are stacked together, the handle of each grill 10 can pass through the opening of the next grill 10 in the stack. This arrangement is shown in FIG. 3B, in which handle 100 of the lower grill is shown as extending through an opening in the upper grill. Depending upon the dimensions thereof, each handle 100 may in fact pass through the openings of a number of grills 10 when more than two grills are stacked together. This is illustrated in FIG. 3C, which shows a stack of several grills 10. In FIG. 3C, the substantially planar portion 90 of each grill 10 has been omitted for clarity of the diagram. From FIGS. 3B and 3C it can be appreciated that the provision of the opening affords significant savings in terms of packaging space and materials when a number of grills 10 are shipped together.

FIG. 4 shows an alternative construction for handle 100. The handle 100 comprises three pieces of wire 97, 98 and 99. A first piece 98 is arranged similarly to the piece of wire comprising the handles shown in FIGS. 1A and 2A (integers 32 and 76 respectively). To provide additional strength however, two additional pieces of wire 97 and 99 are used. These are arranged to run substantially parallel to the first piece 98 and a number of attachments 92 such as welds may be used to secure the respective pieces of wire together. Also shown in FIG. 4 are three separate cross sections of the handle 100, at different positions. While in this embodiment, two additional pieces of wire 97 and 99 have been used, it is envisaged that only one or even more than two additional pieces could be used.

FIG. 5 shows a further type of handle. Here the handle comprises a first piece of wire 80 that is arranged similarly to the handle shown in FIG. 2A. As in the embodiment shown in FIG. 4 however, two additional pieces of wire 81 and 82 have been added. These are attached to the first wire 80 using a number of attachments 92. FIG. 5 also shows the cross section of the handle 100 with respect to the strut 83 at three different positions. In these cross sections, wire 80 is shown using filled circles while wires 81 and 82 are shown using the open circles. Proximal the outermost loop 95, two sections of wire 80 (which loops back on itself to form the mounting formations) lie side by side. Distal the outermost ring 95, these two sections diverge to form strut 83 and part of the handle 100. In each case, wire 81 lies above strut 83 (which comprises a section of wire 80).

In FIGS. 4 and 5, the details of the construction of the substantially planar portions 90 have been omitted for clarity. It is envisaged that the handles described in FIGS. 4 and 5 may be incorporated into the embodiments such as those shown in FIGS. 1, 2 and 3.

FIG. 6 shows a grill 10 mounted on a fan housing 210. As can be seen, the substantially planar portion of the grill 10 covers opening 200 in the fan housing 210, while a handle 100 provides a means by which mounting of the grill may be swiftly effected. It is also evident that, when the grill 10 is mounted on the housing 210, the handle 100 provides a means by which a fan module, including the fan housing 210 enclosing a fan (not shown) and the grill 10 may be carried as a whole.

As will be appreciated the embodiments of the invention hereinbefore described are provided as illustrative examples and various modifications may be made without departing from the spirit and scope of the present invention.

For example, although each of the embodiments have been discussed primarily in terms of a wire construction, it will be appreciated that the these embodiments may also be implemented using for instance a molding or stamping process for form part or all of the grill and handle.

Also, although in the described embodiments each of the components of the substantially planar portion lie within a single plane, it will be appreciated that, for example, at least one of the loops could lie in a different plane or be slightly offset with respect to the other loops. For example, the substantially planar portion could be slightly domed towards the centre thereof in the direction of the handle. Alternatively, an outer loop could be offset with respect to other loops in a direction opposite to the direction in which the handle extends. In this manner, the outer loops could be mounted to the surface of a fan or a housing with a greater clearance being afforded between the remaining loops and the rotating fan blades that would be the case if all of the loops were to lie within a single plane. It will be appreciated that similar considerations could be applied where the substantially planar portion is not formed from a series of loops.

Although the embodiments above have been described in considerable detail, numerous variations and modifications will become apparent to those skilled in the art once the above disclosure is fully appreciated.

What is claimed is:

1. An apparatus, comprising:

a fan housing;

a grill mounted on a surface of the fan housing, the grill comprising:

a substantially planar wire grill portion; and a handle extending out of the substantially planar wire grill portion so as to extend away from the surface of the fan housing when the grill is mounted thereon;

wherein the grill is configured to be stacked with identical grills when apart from the fan housing;

wherein the substantially planar wire grill portion of the grill comprises an opening defined by one or more wires of the substantially planar wire grill portion of the grill and configured to receive a handle of at least one identical grill when two or more identical grills are stacked, apart from their respective fan housings, and wherein the handle of the grill and the opening are configured such that, when at least two of the identical grills are stacked, the substantially planar wire grill portions of the at least two stacked identical grills are substantially parallel, the top of the handle of the lowermost identical grill in the stack is below the corresponding top of the handle of at least one identical grill stacked on the lowermost identical grill, and the handle of the lowermost identical grill passes through the substantially planar wire grill portion of at least one identical grill in the stack such that the handle of the lowermost identical grill can be used to carry the at least two stacked identical grills;

wherein the opening is substantially coplanar with the substantially planar wire grill portion.

2. The apparatus of claim 1, wherein said substantially planar wire grill portion comprises a plurality of apertures.

3. The apparatus of claim 2, wherein at least two of said plurality of apertures are arranged in a grid.

4. The apparatus of claim 1, wherein said substantially planar wire grill portion comprises at least one shaped wire arranged to form a loop or partial loop.

5. The apparatus of claim 4, wherein said substantially planar wire grill portion comprises a plurality of said loops or partial loops.

6. The apparatus of claim 5, wherein said substantially planar wire grill portion comprises at least one strut, each strut attached to at least one of said loops or partial loops in at least one place.

7. The apparatus of claim 6, further comprising at least one mounting formation for mounting the grill on the fan housing, and wherein at least one mounting formation and strut are integrally formed from a piece of shaped wire.

8. The apparatus of claim 6, further comprising at least one mounting formation for mounting the grill on the fan housing, and wherein at least one mounting formation and strut and a portion of the handle of the grill are integrally formed from a piece of shaped wire.

9. The apparatus of claim 1, wherein the handle of the grill comprises a first piece of wire extending in a loop or partial loop away from said substantially planar wire grill portion.

10. The apparatus of claim 9, wherein the handle of the grill comprises at least one additional piece of wire, each additional piece of wire being shaped such that it is substantially parallel to said first piece of wire over the length of that additional piece of wire.

11. The apparatus of claim 1, further comprising one or more mounting formations for mounting the grill on the fan housing.

12. The apparatus of claim 11, wherein at least one of the mounting formations comprises shaped wire extending away from said substantially planar wire gril1 portion and arranged to form a loop or partial loop.

13. The apparatus according to claim 1, wherein the grill comprises:

a section of wire shaped to form at least one loop or partial loop arranged in a common plane, including an outermost loop or partial loop;

a section of wire shaped to provide support for each loop or partial loop;

a first section of wire shaped to form a handle portion of the handle of the grill; and at least one mounting formation.

14. The apparatus of claim 13, wherein the section of wire forming the handle portion extends away from said common plane, and wherein either end of that section of wire is attached to said outermost loop.

15. The apparatus of claim 13 wherein the at least one mounting formation comprises at least two mounting formations formed from shaped wire, said at least two mounting formations and said handle portion being formed from a common section of wire.

16. The apparatus of claim 13, wherein said handle portion comprises at least one additional section of wire.

17. The apparatus of claim 16, wherein the first section of wire and the additional sections of wire forming said handle portion are joined together with a weld or a brazing.

18. The apparatus of claim 13, wherein the section of wire shaped to provide support and at least one mounting formation are formed from a common section of wire.

19. The apparatus of claim 13, comprising further sections of wire shaped to form further loops or partial loops arranged in said common plane.

20. The apparatus of claim 13, comprising further sections of wire arranged to provide further support for the at least one loop or partial loop.

21. The apparatus of claim 20, wherein two of the sections of wire arranged to provide support for the at least one loop or partial loop define said opening in said fan grill, said opening being configured to receive the handle of a second, similar fan grill.

22. The apparatus of claim 1, wherein the handle of the grill is configured such that, when at least three identical grills are stacked, apart from their respective housings, the handle of the lowermost of the at least three identical grills in the stack passes through the opening in the uppermost of the at least three identical grills in the stack.

23. The apparatus of claim 1, wherein a carrying portion of the handle of the grill is vertically spaced above the substantially planar wire grill portion of the grill so as to form a vertical gap between the carrying portion of the handle of the grill and the substantially planar wire grill portion of the grill.

24. The apparatus of claim 23, wherein the handle of the grill comprises a wire, wherein the carrying portion comprises a portion of the wire of the handle of the grill.

25. The apparatus of claim 23, wherein the handle of the grill is configured such that, when at least three identical grills are stacked, apart from their respective housings, the carrying portion of the handle of the lowermost of the at least three identical grills in the stack is above the substantially planar wire grill portion of the uppermost of the at least three grills in the stack.

26. An apparatus, comprising:

a fan housing;

a grill mounted on a surface of the fan housing, the grill comprising:

a substantially planar wire grill portion; and a handle extending out of the substantially planar wire grill portion so as to extend away from the surface of the fan housing when the grill is mounted thereon;

wherein the handle comprises a first piece of wire extending in a loop or partial loop away from said substantially planar wire grill portion;

wherein said handle comprises at least one additional piece of wire, each additional piece of wire being shaped such that it is substantially parallel to said first piece of wire over the length of that additional piece of wire;

wherein each additional piece of wire is attached to said first piece of wire with at least one weld or brazing;

wherein the substantially planar wire grill portion of the grill comprises an opening defined by one or more wires of the substantially planar wire grill portion of the grill and configured to receive a handle of at least one identical grill when two or more identical grills are stacked, apart from their respective fan housings, and wherein the handle of the grill and the opening are configured such that, when at least two of the identical grills are stacked, the substantially planar wire grill portions of the at least two stacked identical grills are substantially parallel, the top of the handle of the lowermost identical grill in the stack is below the corresponding top of the handle of at least one identical grill stacked on the lowermost identical grill, and the handle of the lowermost identical grill passes through the substantially planar wire will portion of at least one identical grill in the stack such that the handle of the lowermost identical grill can be used to carry the at least two stacked identical grills.

27. An apparatus, comprising:

a fan housing;

a grill configured to be mounted on a surface of the fan housing, the grill comprising:

a substantially planar wire grill portion;

a handle extending out of the substantially planar wire grill portion so as to extend away from the surface of the fan housing when the grill is mounted thereon; and one or more mounting fonnations for mounting the grill on the fan housing;

wherein the at least one mounting formation and a portion of said handle are integrally formed from a single piece of shaped wire;

wherein the substantially planar wire grill portion of the grill comprises an opening defined by one or more wires of the substantially planar wire grill portion of the grill and configured to receive a handle of at least one identical grill when two or more identical grills are stacked, apart from their respective fan housings, and wherein the handle of the grill and the opening are configured such that, when at least two of the identical grills are stacked, the substantially planar wire grill portions of the at least two stacked identical grills are substantially parallel, the top of the handle of the lowermost identical grill in the stack is below the corresponding top of the handle of at least one identical grill stacked on the lowermost identical grill, and the handle of the lowermost identical grill passes through the substantially planar wire grill portion of at least one identical will in the stack such that the handle of the lowermost identical grill can be used to carry the at least two stacked identical grills.

28. An apparatus, comprising:

a fan housing;

a grill mounted on a surface of the fan housing, the grill comprising:

a substantially planar wire grill portion; and a handle extending out of the substantially planar wire grill portion so as to extend away from the surface of the fan housing when the grill is mounted thereon;

wherein said substantially planar wire grill portion comprises at least one shaped wire arranged to form a loop or partial loop;

wherein said substantially planar wire grill portion comprises a plurality of said loops or partial loops;

wherein said substantially planar wire grill portion comprises at least one strut, each strut attached to at least one of said loops or partial loops in at least one place; and wherein at least one strut and at least a portion of said handle are integrally formed from a single piece of shaped wire;

wherein the substantially planar wire grill portion of the grill comprises an opening defined by one or more wires of the substantially planar wire grill portion of the grill and configured to receive a handle of at least one identical grill when two or more identical grills are stacked, apart from their respective fan housings, and wherein the handle of the grill and the opening are configured such that, when at least two of the identical grills are stacked, the substantially planar wire grill portions of the at least two stacked identical grills are substantially parallel, the top of the handle of the lowermost identical grill in the stack is below the corresponding top of the handle of at least one identical grill stacked on the lowermost identical grill, and the handle of the lowermost identical grill passes through the substantially planar wire grill portion of at least one identical grill in the stack such that the handle of the lowermost identical grill can be used to carry the at least two stacked identical grills.

* * * * *

UNITED STATES PATENT AND TRADEMARK OFFICE

CERTIFICATE OF CORRECTION

PATENT NO. : 7,690,888 B2
APPLICATION NO. : 10/809138
DATED : April 6, 2010
INVENTOR(S) : Paul J. Garnett It is certified that error appears in the above-identified patent and that said Letters Patent is hereby corrected as shown below:

In the Claims:

Claim 12, col. 7, line 56, please change "gril1" to "grill".

Claim 26, col. 9, line 16, please change "will" to "grill".

Claim 27, col. 9, line 27, please change "fonnations" to "formations".

Claim 27, col. 10, line 3, please change "will" to "grill".

Signed and Sealed this

Twenty-fifth Day of May, 2010

David J. Kappos

David J. Kappos
*Director of the United States Patent and Trademark Office*